US008159398B2

(12) United States Patent
Su

(10) Patent No.: US 8,159,398 B2
(45) Date of Patent: Apr. 17, 2012

(54) BUILT-IN MULTI-ANTENNA MODULE

(75) Inventor: Saou-Wen Su, Taipei (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 392 days.

(21) Appl. No.: 12/559,748

(22) Filed: Sep. 15, 2009

(65) Prior Publication Data

US 2010/0295736 A1 Nov. 25, 2010

(30) Foreign Application Priority Data

May 20, 2009 (CN) ..... 2009 1 0203713

(51) Int. Cl.
*H01Q 1/38* (2006.01)

(52) U.S. Cl. ..... 343/700 MS; 343/848

(58) Field of Classification Search ..... 343/700 MS, 343/848, 853, 893
See application file for complete search history.

(56) References Cited

U.S. PATENT DOCUMENTS 6,819,291 B1 * 11/2004 Lackey et al. ..... 343/700 MS
7,170,449 B2 * 1/2007 Eide ..... 343/700 MS
2011/0090129 A1 * 4/2011 Weily et al. ..... 343/770
* cited by examiner

*Primary Examiner* — Tan Ho
(74) *Attorney, Agent, or Firm* — Li&Cai Intellectual Property (USA) Office

(57) ABSTRACT

A built-in multi-antenna module includes a grounding unit, a plurality of first radiating units and a plurality of second radiating units. The first and the second radiating units are disposed on the grounding unit. Each first radiating unit has a first radiating body, a first feeding pin extended downwards from the first radiating body, and a first shorting pin extended downwards from the first radiating body and connected to the grounding unit. Each second radiating unit has a second radiating body, a second feeding pin extended downwards from the second radiating body, and a second shorting pin extended downwards from the second radiating body and connected to the grounding unit. The first radiating units and the second radiating units are alternately and symmetrically arranged on the grounding unit, and many included angles respectively formed between each first radiating unit and each second radiating unit are the same.

20 Claims, 8 Drawing Sheets

BUILT-IN MULTI-ANTENNA MODULE

BACKGROUND OF THE INVENTION

1. Field of the Invention

The present invention relates to a multi-antenna module, in particular, to a built-in multi-antenna module.

2. Description of Related Art

Wireless LAN or 802.11a/b/g/n access-point antennas of the prior art are almost of external antenna structure. Common dipole antennas have a plastic or rubber sleeve covering thereon. In general, the dipole antenna is a single-band antenna for 2.4 GHz operation or a dual-band antenna for 2.4/5 GHz operation. The height of the dipole antenna is triple the thickness of the wireless broadband router/hub device, and one part of the dipole antenna is disposed on a side of the router and the rest of the dipole antenna is protruding from the top housing of the router. However, the protruded part of the dipole antenna can easily be vandalized by outside force and also occupies space, which deteriorates the aesthetic appeal of the product, especially for the multi-antenna system.

When wireless LAN applied to 2.4/5 GHz or 802.11a/b/g/n applied to a dual-band antenna, the antenna has a single signal feeding port only. Typical dual-band antenna is a dual-band access-point dipole antenna that has two radiation copper pipes and uses coaxial transmission line to achieve dual-band operation for 2.4/5 GHz operation. However, the typical dual-band antenna needs to use diplexers to simultaneously transmit and/or receive the 2.4 GHz and 5 GHz band signals to 2.4 GHz module and 5 GHz module, so that the cost would be increased and the whole system power loses extra gain. Hence, two single-band antennas are respectively operated in the 2.4 GHz and 5 GHz bands to achieve concurrent dual-band operation in order to solve the above-mentioned drawbacks.

Moreover, the prior art another provides a dual-band cross polarization dipole antenna structure that discloses a dual antenna system. The dual antenna system has two dual-band dipole antennas to generate two operating frequency bands for 2.4 GHz and 5 GHz operation. However, the antenna structure is a stack structure, so that the height of the whole antenna structure is high.

However, the above-mentioned prior art has the following common defects: 1. The traditional dipole antenna needs to use the plastic or rubber sleeve covering around the antenna, so that the cost is increased; 2. The antenna of the prior art can not be fully hidden in the router, so that the aesthetic appeal of the product that uses the antenna of the prior art is deteriorated.

SUMMARY OF THE INVENTION

In view of the aforementioned issues, the present invention provides a built-in multi-antenna module. The present invention not only has some advantages such as small size, low profile, good isolation and good radiation properties but also can replace the external dual-band access-point antenna of the prior art for 2.4/5 GHz operation with no need of extra diplexer. In addition, the built-in multi-antenna module can be hidden in the router in order to enhance the appearance of the product that uses the built-in multi-antenna module.

To achieve the above-mentioned objectives, the present invention provides a built-in multi-antenna module, including: a grounding unit, a plurality of first radiating units, and a plurality of second radiating units. The first radiating units are disposed on the grounding unit. Each first radiating unit has a first radiating body parallel to the surface of the grounding unit, a first feeding pin being extended downwards from one side of the first radiating body and being suspended, and a first shorting pin being extended downwards from one side of the first radiating body and being connected to the grounding unit. The second radiating units are disposed on the grounding unit. Each second radiating unit has a second radiating body parallel to the surface of the grounding unit, a second feeding pin being extended downwards from one side of the second radiating body and being suspended, and a second shorting pin being extended downwards from one side of the second radiating body and being connected to the grounding unit. In addition, the first radiating units and the second radiating units are alternately and symmetrically arranged on the grounding unit, and many included angles respectively formed between each first radiating unit and each second radiating unit are substantially the same.

To achieve the above-mentioned objectives, the present invention provides a built-in multi-antenna module installed in an antenna system housing, including: a grounding unit, a plurality of first radiating units, and a plurality of second radiating units. The first radiating units are disposed on the grounding unit. Each first radiating unit has a first radiating body parallel to the surface of the grounding unit, a first feeding pin being extended downwards from one side of the first radiating body and being suspended, and a first shorting pin being extended downwards from one side of the first radiating body and being connected to the grounding unit. The second radiating units are disposed on the grounding unit. Each second radiating unit has a second radiating body parallel to the surface of the grounding unit, a second feeding pin being extended downwards from one side of the second radiating body and being suspended, and a second shorting pin being extended downwards from one side of the second radiating body and being connected to the grounding unit. In addition, the first radiating units and the second radiating units are alternately and symmetrically arranged on the grounding unit, many included angles respectively formed between each first radiating unit and each second radiating unit are substantially the same, and the grounding unit, the first radiating units and the second radiating units are enclosed by the antenna system housing.

To achieve the above-mentioned objectives, the present invention provides a built-in multi-antenna module installed in an antenna system housing, including: a grounding unit and a plurality of radiating sets. The radiating sets with different antenna operating frequencies are disposed on the grounding unit. Each radiating set has a plurality of radiating units with the same operating frequency, and each radiating unit has a radiating body parallel to the surface of the grounding unit, a feeding pin being extended downwards from one side of the radiating body and being suspended and a shorting pin being extended downwards from one side of the radiating body and being connected to the grounding unit. In addition, the radiating units of the radiating sets are alternately and symmetrically arranged on the grounding unit, many included angles respectively formed between every two radiating units of the radiating sets are substantially the same, many included angles respectively formed between every two radiating units of each radiating set are substantially the same, and the grounding unit and the radiating units of the radiating sets are enclosed by the antenna system housing.

Therefore, the present invention has the following advantages:

1. In the above-mentioned examples, the present invention uses three independent single-band antennas for 2.4 GHz operation and three independent single-band antennas for 5 GHz operation in order to achieve concurrent dual-band operation. On the contrary, the dual-band antenna of the prior art has a single signal feeding port only, so that the dual-band antenna of the prior art needs to use diplexers to achieve concurrent dual-band operation. Therefore, for the dual-band antenna of the prior art, the cost would be increased and the whole system loses extra gain.

2. The multi-antenna module of the present invention can be hidden in the router in order to enhance the appearance of the product that uses the built-in multi-antenna module.

3. In the embodiments of the present invention, the first radiating units and the second radiating units can be bent to reduce the height of the multi-antenna module. The present invention can obtain good impedance match (2:1 VSWR or 10 dB return loss) for WLAN operation in the 2.4/5 GHz bands by adjusting the height of the radiating units and the distance between each feeding pin and each shorting pin.

4. Because the shorting pin of each radiating unit with one antenna operating frequency is adjacent to the feeding pin of each radiating unit with another antenna operating frequency, the mutual coupling between every two radiating units with different antenna operating frequencies is substantially decreased and the isolation can remain under −15 dB.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1:
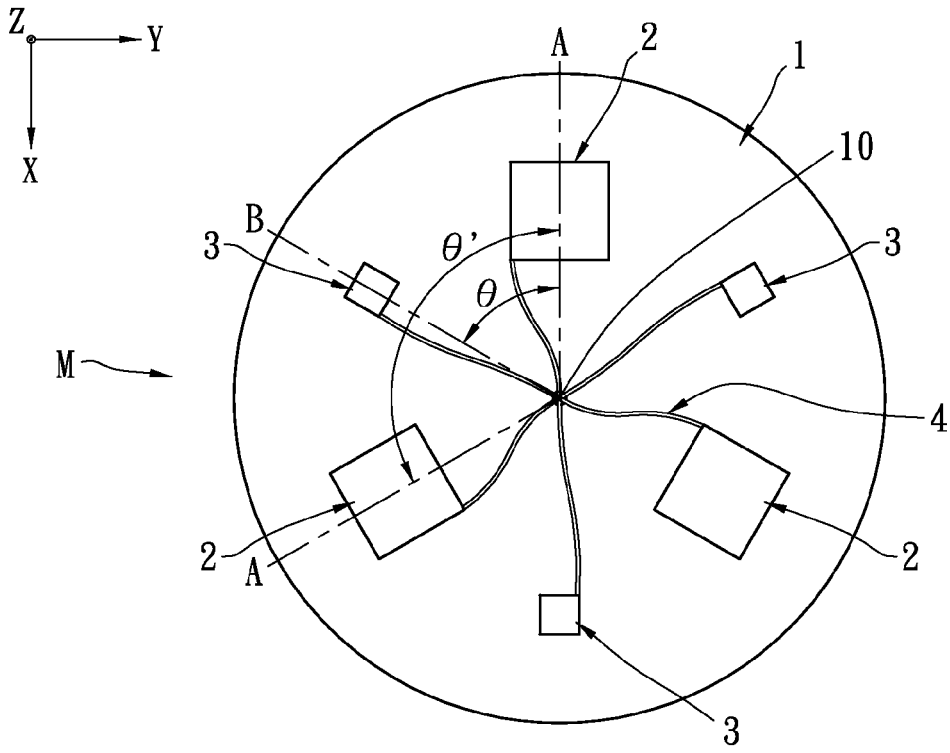
FIG. 1 is a top, schematic view of the built-in multi-antenna module according to the present invention.

Referring to FIGS. 1 to 3D, the present invention provides a built-in multi-antenna module M, including: a grounding unit 1, a plurality of first radiating units 2 and a plurality of second radiating units 3. The first radiating units 2 and the second radiating units 3 are alternately and symmetrically arranged on the grounding unit 1 (the distance between the edge of the grounding unit 1 and each first radiating unit 2 or each second radiating unit 3 would affect the antenna performance of the present invention, in other words, the distance can affect impedance bandwidth and radiation pattern in the x-z plane), and many included angles θ (Each included angle is made by two lines with a common vertex) respectively formed between the geometric center of each first radiating unit 2 and the geometric center of each second radiating unit 3 are substantially the same. For example, each included angle θ is made by two adjacent center lines (A, B) with a common vertex, and each included angle θ' is made by two center lines (A, A) with a common vertex. The center line A is defined from the geometric center of the ground unit 1 to pass the geometric center of each first radiating unit 2, and the center line B is defined from the geometric center of the ground unit 1 to pass the geometric center of each second radiating unit 2. In other words, the first radiating units 2 and the second radiating units 3 are set in a sequential, rotating arrangement on the grounding unit 1, and the first radiating unit 2 and the second radiating units 3 are facing each other one by one.

For example, in the embodiment of the present invention, the number of the first radiating units 2 is three, the number of the second radiating units 3 is three, and each included angle θ between each first radiating unit 2 and each second radiating unit 3 is 60 degrees, each included angle θ' between the two adjacent first radiating unit 2 is 120 degrees (as shown in FIG. 1). However, the above-mentioned number of the first radiating units 2 or the second radiating units 3 and the above-mentioned included angles θ respectively formed between each first radiating unit 2 and each second radiating unit 3 or the included angles θ' respectively formed between the two adjacent first radiating unit 2 are only examples, and these do not limit the present invention.

Moreover, the grounding unit 1 can be a regular polygonal conductive plate (not shown), a circular conductive plate or any conductive plates with a predetermined shape, and the grounding unit 1 has a through hole 10 formed on a central portion thereof. In addition, the built-in multi-antenna module M further includes a plurality of signal wires 4 passing through the through hole 10, so that the signal wires 4 can be routed neatly by passing through the through hole 10. Furthermore, antenna signals received by the first radiating units 2 or the second radiating units 3 can be transmitted to PCB (not shown) of a router by using the signal wires 4. Of course, the present invention can omit the through hole 10, so that the signal wires 4 can be attached to the top surface of the grounding unit 1 in order to facilitate the cable routing for the signal wires 4.

Figure 2:
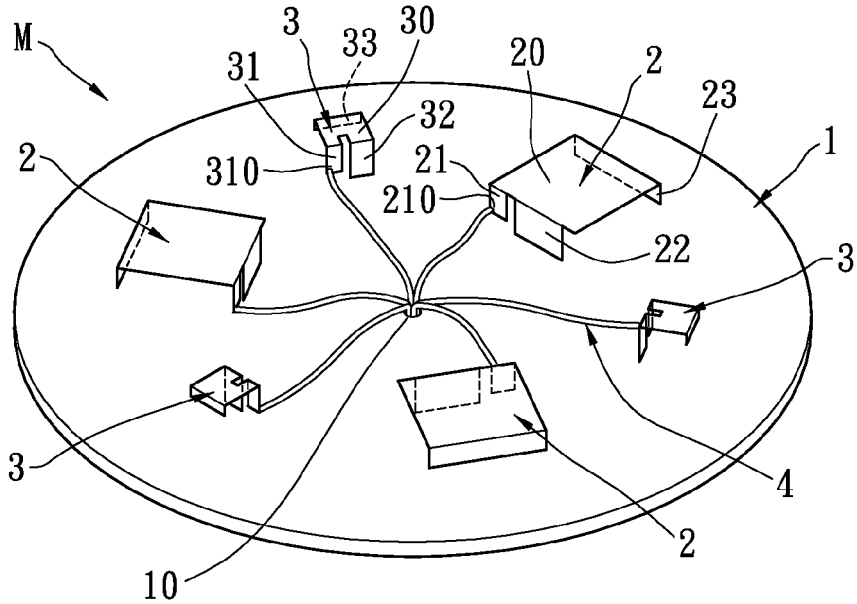
FIG. 2 is a perspective, schematic view of the built-in multi-antenna module according to the present invention.
Figure 3A:
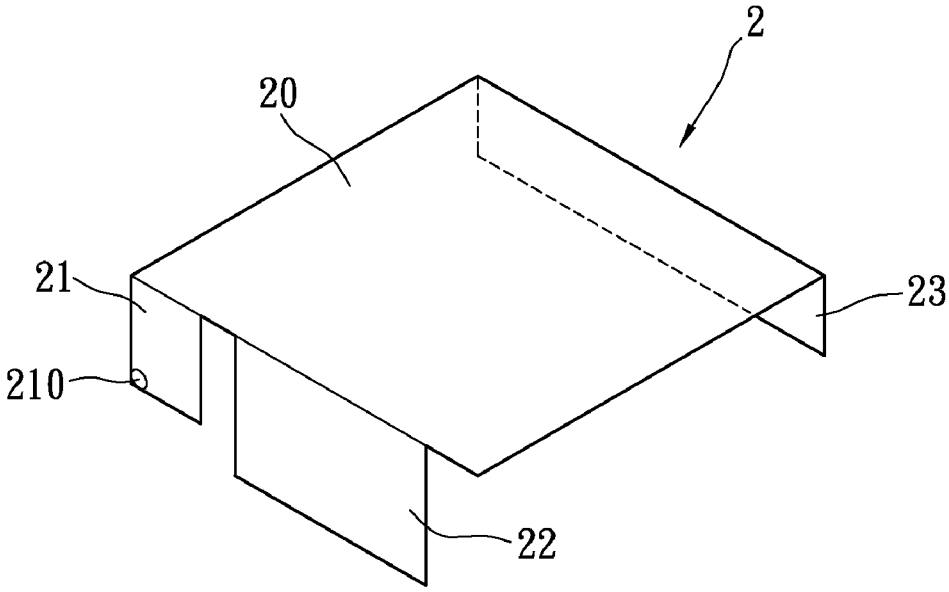
FIG. 3A is a perspective, schematic view of the first type of the first radiating unit of the built-in multi-antenna module according to the present invention.
Figure 3B:
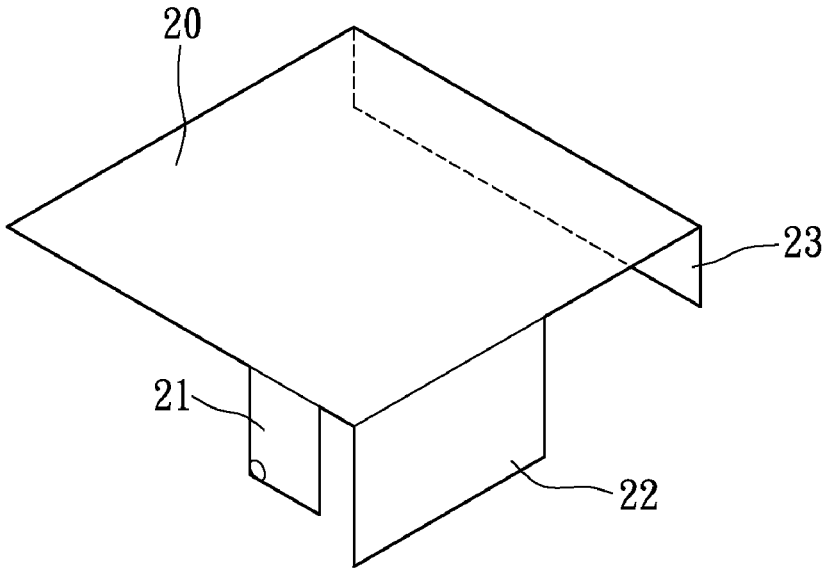
FIG. 3B is a perspective, schematic view of the second type of the first radiating unit of the built-in multi-antenna module according to the present invention.

In addition, referring to FIGS. 2 and 3A, the first radiating units 2 are disposed on the grounding unit 1. Each first radiating unit 2 has a first radiating body 20 parallel to the surface of the grounding unit 1, a first feeding pin 21 being extended downwards from one side of the first radiating body 20 and being suspended, and a first shorting pin 22 being extended downwards from one side of the first radiating body 20 and being connected to the grounding unit 1. In the FIG. 3A, a perspective, schematic view of the first type of the first radiating unit of the present invention, the first feeding pin 21 and the first shorting pin 22 are disposed on the same side of the first radiating body 20. Referring to FIG. 3B, a perspective, schematic view of the second type of the first radiating unit of the present invention, the first feeding pin 21 and the first shorting pin 22 of each first radiating unit 2 also can be disposed on two adjacent sides of the first radiating body 20, respectively.

Figure 5:
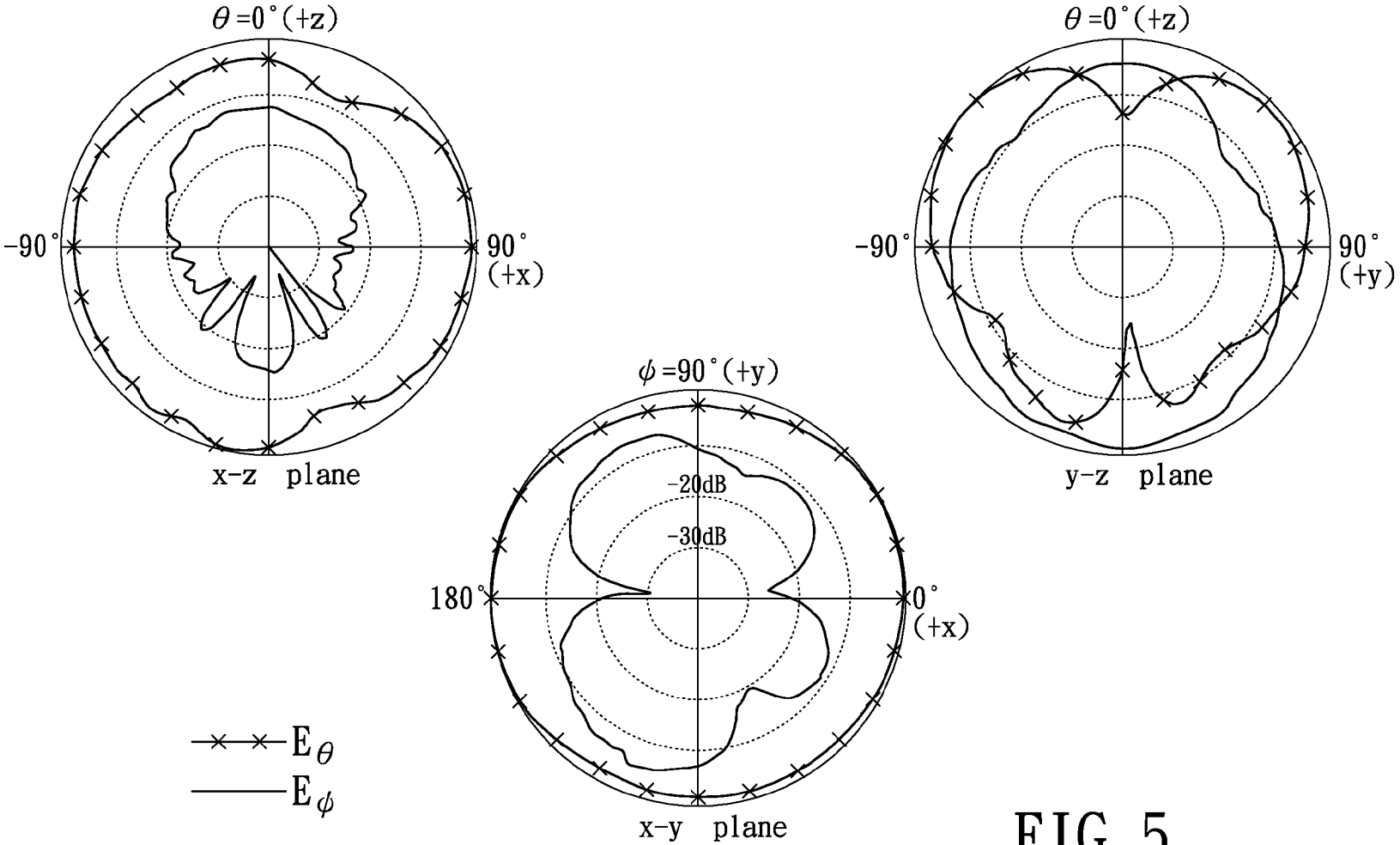
FIG. 5 shows radiation patterns of one first radiating unit at 2442 MHz in different planes (such as x-z plane, y-z plane and x-y plane) according to the present invention.

Referring to FIGS. 1 and 5, FIG. 5 shows measurement results of radiation patterns of one first radiating unit 2 (the topmost first radiating unit 2 in FIG. 1) at 2442 MHz in different planes (such as x-z plane, y-z plane and x-y plane) according to the definition of the coordinate in FIG. 1. Conical radiation patterns are shown in the y-z plane and omnidirectional radiation patterns are shown in the x-y plane.

Figure 3C:
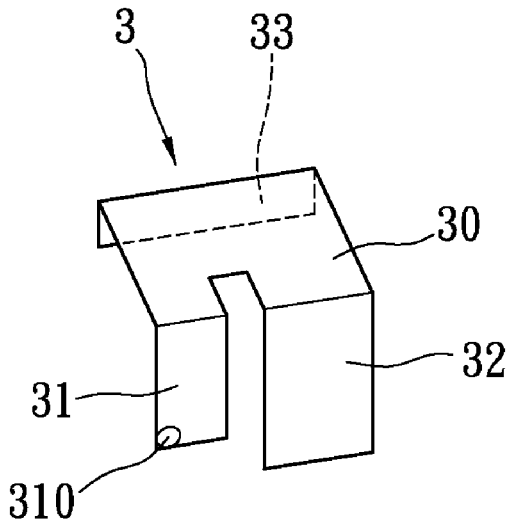
FIG. 3C is a perspective, schematic view of the first type of the second radiating unit of the built-in multi-antenna module according to the present invention.
Figure 3D:
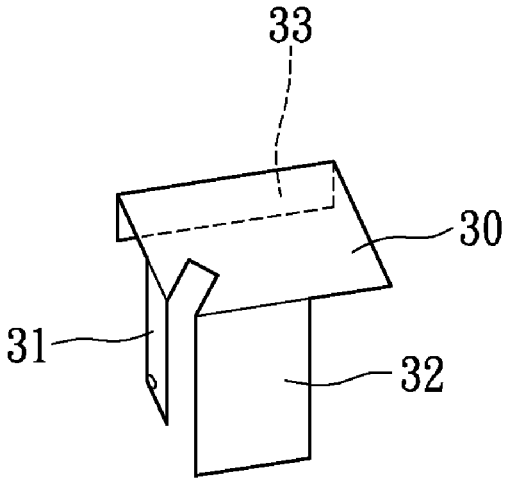
FIG. 3D is a perspective, schematic view of the second type of the second radiating unit of the built-in multi-antenna module according to the present invention.

In addition, referring to FIGS. 2 and 3C, the second radiating units 3 are disposed on the grounding unit 1. Each second radiating unit 3 has a second radiating body 30 parallel to the surface of the grounding unit 1, a second feeding pin 31 being extended downwards from one side of the second radiating body 30 and being suspended, and a second shorting pin 32 being extended downwards from one side of the second radiating body 30 and being connected to the grounding unit 1. In the FIG. 3C, a perspective, schematic view of the first type of the second radiating unit of the present invention, the second feeding pin 31 and the second shorting pin 32 are disposed on the same side of the second radiating body 30. Referring to FIG. 3D, a perspective, schematic view of the second type of the second radiating unit of the present invention, the second feeding pin 31 and the second shorting pin 32 of each second radiating unit 3 also can be disposed on two adjacent sides of the second radiating body 30, respectively.

Figure 6:
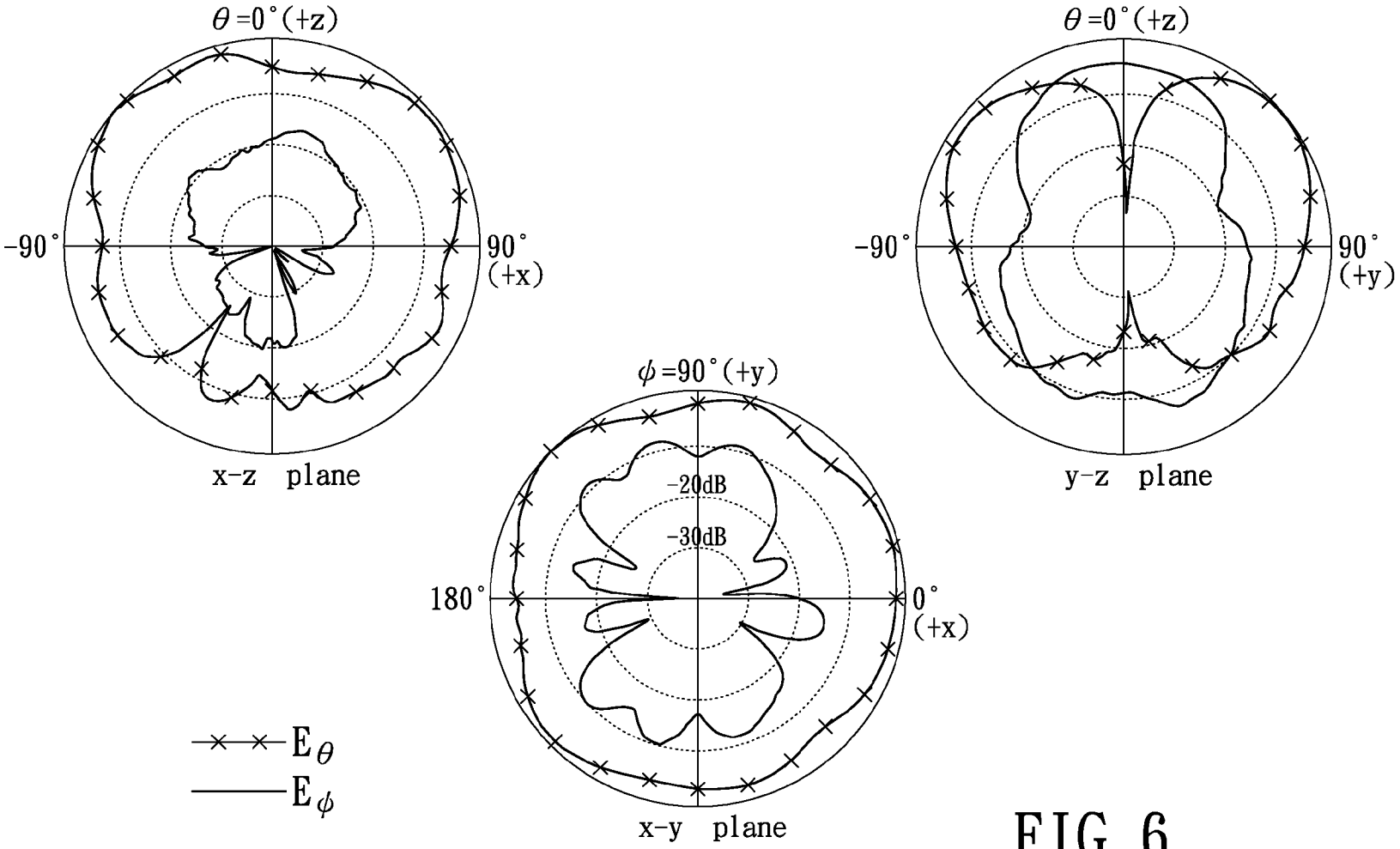
FIG. 6 shows radiation patterns of one second radiating unit at 5490 MHz in different planes (such as x-z plane, y-z plane and x-y plane) according to the present invention.

Referring to FIGS. 1 and 6, FIG. 6 shows measurement results of radiation patterns of one second radiating unit 3 (the bottommost second radiating unit 3 in FIG. 1) at 5490 MHz in different planes (such as x-z plane, y-z plane and x-y plane) according to the definition of the coordinate in FIG. 1. Similar conical radiation patterns are shown in the y-z plane and omnidirectional radiation patterns are shown in the x-y plane.

Furthermore, the first radiating unit 2 and the second radiating unit 3 have some different design aspects, as follows:

1. Referring to FIG. 2, the first feeding pin 21 of each first radiating unit 2 is adjacent to the second shorting pin 32 of one adjacent second radiating unit 3, and the first shorting pin 22 of each first radiating unit 2 is adjacent to the second feeding pin 31 of another adjacent second radiating unit 3. Similarly, the second feeding pin 31 of each second radiating unit 3 is adjacent to the first shorting pin 22 of one adjacent first radiating unit 2, and the second shorting pin 32 of each second radiating unit 3 is adjacent to the first feeding pin 21 of another adjacent first radiating unit 2. In other words, looking at any one first radiating unit 2, the first feeding pin 21 of the first radiating unit 2 is adjacent to the second shorting pin 32 of the second radiating unit 3 that is disposed beside the left side of the first radiating unit 2, and the first shorting pin 22 of the first radiating unit 2 is adjacent to the second feeding pin 31 of the second radiating unit 3 that is disposed beside the right side of the first radiating unit 2. The above-mentioned alternate-antenna design can prevent the first feeding pins 21 and the second feeding pins 31 from being interfered with each other and prevent the first shorting pins 22 and the second shorting pins 32 from being interfered with each other.

2. Referring to FIGS. 3A and 3C, the first feeding pin 21 and the first shorting pin 22 of each first radiating unit 2 are separated from each other by a predetermined distance, and the second feeding pin 31 and the second shorting pin 32 of each second radiating unit 3 are separated from each other by a predetermined distance, in order to obtain good impedance match. In addition, a designer can adjust the above-mentioned predetermined distances in order to change antenna operating frequency according to different design requirements. In other words, the predetermined distance between the first feeding pin 21 and the first shorting pin 22 of each first radiating unit 2 and the predetermined distance between the second feeding pin 31 and the second shorting pin 32 of each second radiating unit 3 can be adjusted according to different antenna performance that a designer wants.

3. Referring to FIGS. 3A and 3C, the first feeding pin 21 and the first shorting pin 22 of each first radiating unit 2 are disposed on the same plane, and the second feeding pin 31 and the second shorting pin 32 of each second radiating unit 3 are disposed on the same plane. Of course, the first feeding pin 21 and the first shorting pin 22 of each first radiating unit 2 can be disposed on different planes as shown in FIG. 3B, and the second feeding pin 31 and the second shorting pin 32 of each second radiating unit 3 can be disposed on different planes as shown in FIG. 3D, according to different design requirements. For example, referring to FIG. 3B, if the first feeding pin 21 and the first shorting pin 22 of each first radiating unit 2 are respectively disposed on two adjacent sides of the first radiating body 20, the first feeding pin 21 and the first shorting pin 22 of each first radiating unit 2 are not disposed on the same plane. In addition, the height of each first radiating unit 2 can be different from the height of each second radiating unit 3, and also the first radiating unit 2 and the second radiating unit 3 can be disposed on the different planes. In other words, the first radiating unit 2 and the second radiating unit 3 can be disposed on the different surfaces of the grounding unit 1.

4. Referring to FIGS. 3A and 3C, the first feeding pins 21 are respectively vertically or slantwise extended downwards from the side of the first radiating bodies 20, and the first shorting pins 22 are respectively vertically or slantwise extended downwards from the side of the first radiating bodies 20. The second feeding pins 31 are respectively vertically or slantwise extended downwards from the side of the second radiating bodies 30, and the second shorting pins 32 are respectively vertically or slantwise extended downwards from the side of the second radiating bodies 30.

5. The antenna operating frequencies of the first radiating units 2 are the same (such as antenna lower band), and the antenna operating frequencies of the second radiating units 3 are the same (such as antenna upper band). For example, the antenna operating frequencies of each first radiating unit 2 can be in the 2.4 GHz band, and the antenna operating frequencies of each second radiating unit 3 can be in the 5 GHz band.

Figure 4A:
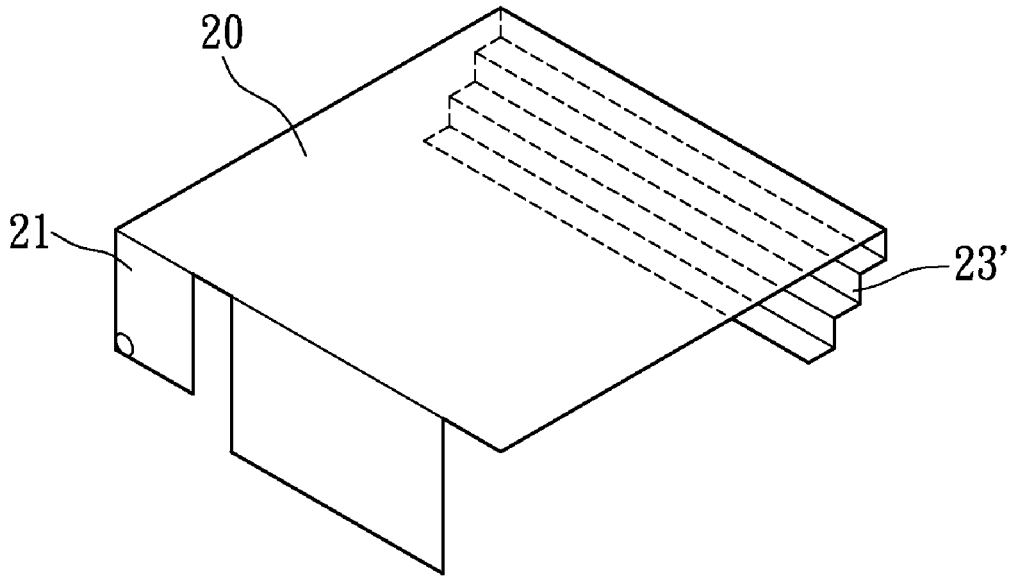
FIG. 4A is a perspective, schematic view of the third type of the first radiating unit of the built-in multi-antenna module according to the present invention.
Figure 4B:
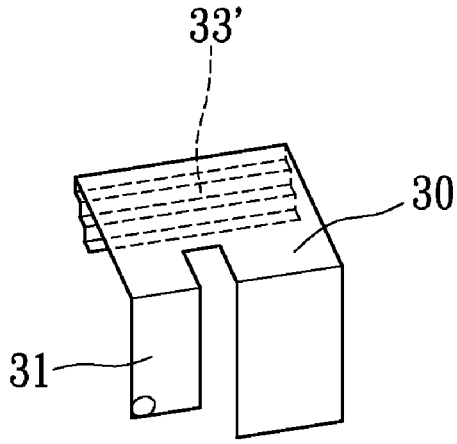
FIG. 4B is a perspective, schematic view of the third type of the second radiating unit of the built-in multi-antenna module according to the present invention.

6. Referring to FIGS. 3A and 3C, each first radiating unit 2 has a first extending portion 23 extended downwards from another side, opposite to the first feeding pin 21 or the first shorting pin 22, of the first radiating body 20. The first extending portion 23 is bent in order to reduce the whole size of the first radiating unit 2 with the same resonant path. Of course, the first extending portion 23 also can not be bent and parallel to the grounding unit 1, but the whole size of the first radiating unit 2 with the same resonant path would be increased. Hence, each first extending portion 23 and each first feeding pin 21 (or each first shorting pin 22) are respectively disposed on two opposite sides of each first radiating body 20. Furthermore, each second radiating unit 3 has a second extending portion 33 extended downwards from another side, opposite to the second feeding pin 31 or the second shorting pin 32, of the second radiating body 30. The second extending portion 33 is bent in order to reduce the whole size of the second radiating unit 3 with the same resonant path. Of course, the second extending portion 33 also can not be bent and parallel to the grounding unit 1, but the whole size of the second radiating unit 3 on the same resonant path would be increased. Hence, each second extending portion 33 and each second feeding pin 31 (or each second shorting pin 32) are respectively disposed on two opposite sides of each second radiating body 30. In addition, referring to FIGS. 3B and 3D, in another embodiment, the position of the first shorting pin 22 can be changed according to different design requirements, so that the first extending portion 23 does not correspond to the first shorting pin 22, and the position of the second feeding pin 31 also can be changed according to different design requirement, so that the second extending portion 33 does not correspond to the second feeding pin 31. Moreover, referring to FIGS. 4A and 4B, each first extending portion 23' also can be bent continuously and downwards from each first radiating body 20, and each second extending portion 33' also can be bent continuously and downwards from each second radiating body 30.

7. Referring to FIG. 2, each first feeding pin 21 has a first feeding point 210 on a bottom portion thereof, and each second feeding pin 31 has a second feeding point 310 on a bottom portion thereof. The first feeding points 210 and the second feeding points 310 face the geometric center of the grounding unit 1. In addition, the distance between each first feeding point 210 and the geometric center of the grounding unit 1 can be different from the distance between each second feeding point 310 and the geometric center of the grounding unit 1, but the distance between each first feeding point 210 or each second feeding point 310 and the geometric center of the grounding unit 1 is the same. Moreover, the signal wires 4 are respectively connected to the first feeding points 210 of the first feeding pins 21 and the second feeding points 310 of the second feeding pins 31. Hence, antenna signals received by the first radiating units 2 or the second radiating units 3 can be transmitted to PCB of a router by using the signal wires 4.

8. Referring to FIG. 2, shapes and sizes of the first radiating units 2 are the same, and shapes and sizes of the second radiating units 3 are the same. In the present embodiment, the size of each first radiating unit 2 (the antenna at operating frequency 2.4 GHz band) is larger than the size of each second radiating unit 3 (the antenna at operating frequency 5 GHz band). In addition, the first radiating units 2 and the second radiating units 3 are made of metal conductive plates by stamping (or cutting) and bending. In general, the bending angle can be a right angle, but it does not limit the present invention.

9. The heights of each first radiating unit 2 and each second radiating unit 3 relative to the grounding unit 1 are between 0.1 mm and 10 mm, and the preferable heights of each first radiating unit 2 and each second radiating unit 3 relative to the grounding unit 1 are between 5 mm and 10 mm. In addition, the antenna operating frequencies and the direction of maximum radiation patterns and impedance matching can be changed by adjusting the heights of each first radiating unit 2 and each second radiating unit 3 relative to the grounding unit 1 according to different design requirements.

However, the above-mentioned designs for the first radiating units 2 and the second radiating units 3 are merely provided for reference and illustration, without any intention to be used for limiting the present invention. If only the first radiating units 2 and the second radiating units 3 are alternately and symmetrically arranged on the grounding unit 1 and the included angles θ between each first radiating unit 2 and each second radiating unit 3 are the same. Various equivalent changes, alternations or modifications based on the present invention are all consequently viewed as being embraced by the scope of the present invention.

Figure 7:
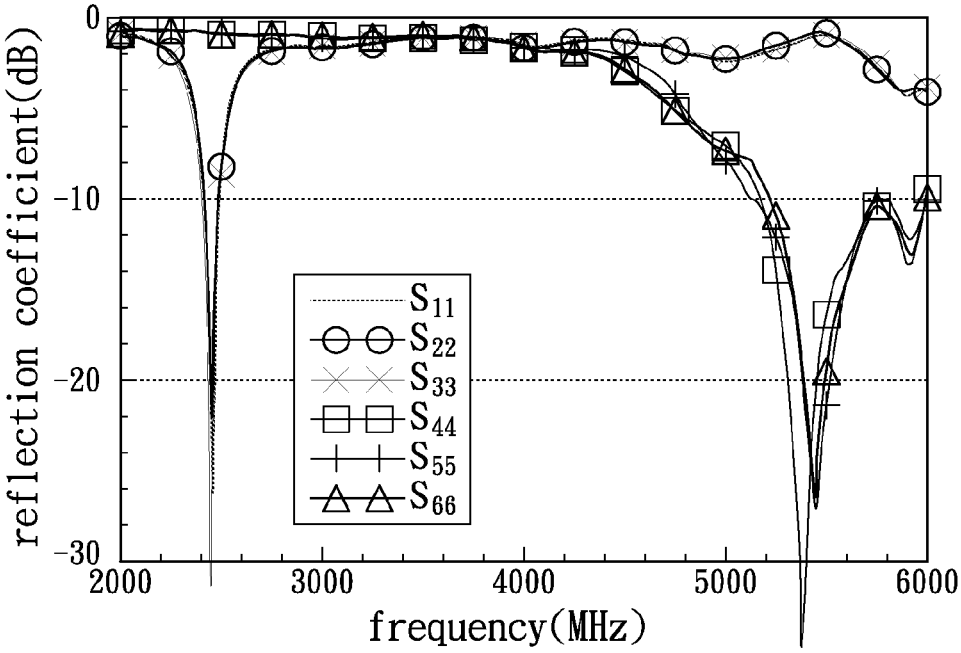
FIG. 7 is a curve diagram of the reflection coefficients (S parameters (dB)) of the first radiating units and the second radiating units against frequencies (MHz) according to the present invention.

FIG. 7 shows reflection coefficients (S parameters (dB)) of the first radiating units 2 (such as curves of $S_{11}$, $S_{22}$ and $S_{33}$) and the second radiating units 3 (such as curves of $S_{44}$, $S_{55}$ and $S_{66}$) against frequencies (MHz) according to the test results of the first radiating units 2 and the second radiating units 3.

Figure 8:
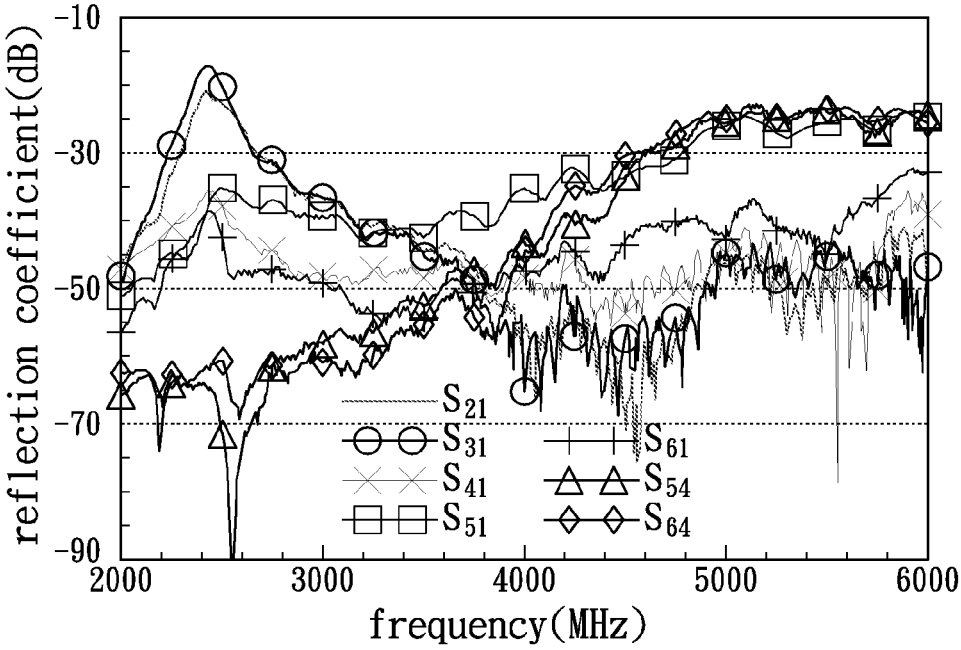
FIG. 8 is a curve diagram (only showing seven curves) of the isolation (S parameters (dB)) between any one of the first radiating units and any one of the second radiating units against frequencies (MHz) according to the present invention.

FIG. 8 shows the isolation (S parameters (dB)) between any one of the first radiating units 2 and any one of the second radiating units 3 against frequencies (MHz) according to the test results of the first radiating units 2 and the second radiating units 3. In FIG. 8, it is only presented by the curves of S21, S31, S41, S51, S61, S54 and S64. The six radiating units (in this embodiment, there are three first radiating units 2 and three second radiating units 3) are respectively defined by numbers of 1 to 6, the topmost first radiating unit 2 in FIG. 1 is defined by number of 1, the other first radiating units 2 are anti-clockwise defined by number of 2 and 3 in sequence, and the second radiating units 3 are anti-clockwise defined by number 4, 5 and 6 in sequence, wherein the two second radiating units defined by number of 4 and 5 are adjacent the first radiating unit defined by number of 1. For example, S21 means the isolation between first one and second one of the first radiating units 2, S51 means the isolation between first one of the first radiating units 2 and second one of the second radiating units 3, and S64 means the isolation between first one and third one of the second radiating units 3.

Figure 9:
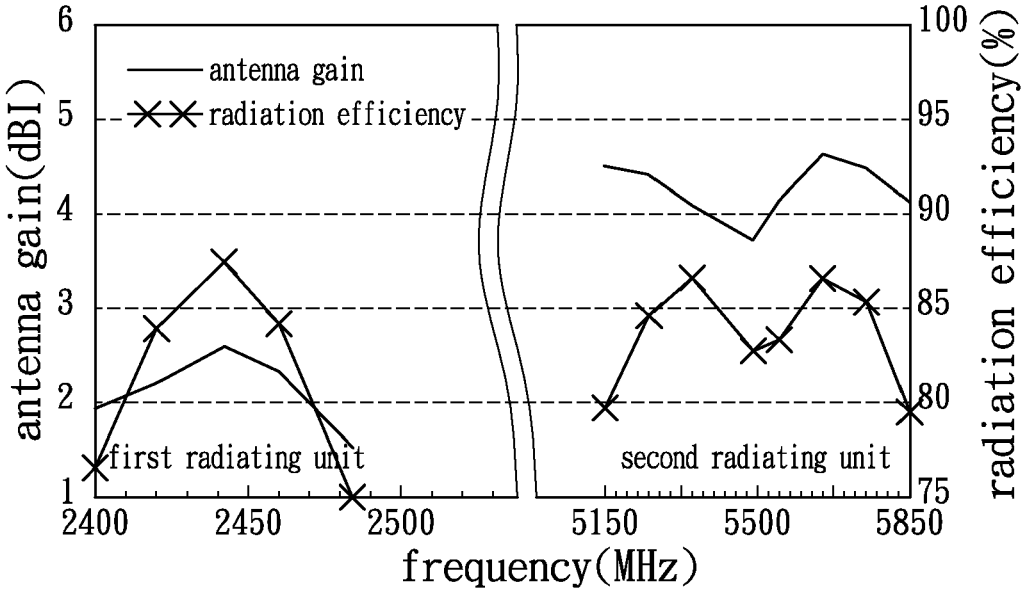
FIG. 9 is a curve diagram of the peak antenna gain (dBi) and the radiation efficiency (%) of one of the first radiating units and one of the second radiating units against frequencies (MHz) according to the present invention.

FIG. 9 shows peak antenna gain (dBi) and radiation efficiency (%) of one of the first radiating units 2 and one of the second radiating units 3 against frequencies (MHz) according to the test results of the first radiating units 2 and the second radiating units 3.

Figure 10:
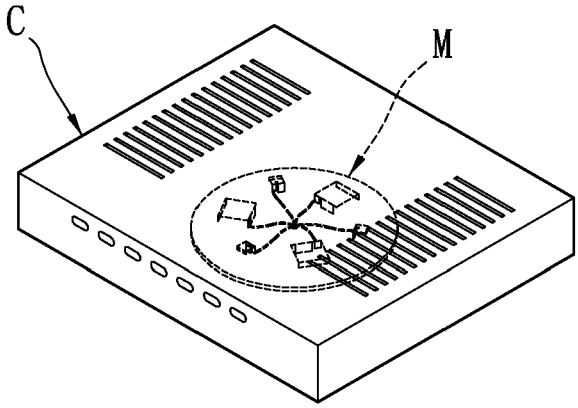
FIG. 10 is a lateral, perspective, schematic view of the built-in multi-antenna module installed in an antenna system housing according to the present invention.

Referring to FIGS. 1 and 10, the built-in multi-antenna module M of the present invention can be installed in an antenna system housing C (such as antenna system housing of router or hub), for example, the built-in multi-antenna module M can be installed on the internal side of a top cover of the antenna system housing C. In other words, the grounding unit 1, the first radiating units 2 and the second radiating units 3 are enclosed by the antenna system housing C. Hence, the multi-antenna module M can be hidden in the antenna system product without need to be placed outside the antenna system housing C in order to enhance the appearance of the product that uses the built-in multi-antenna module M.

Moreover, the definition of "the built-in multi-antenna module M including the first radiating units 2 and the second radiating units 3" does not limit the present invention. For example, the definition of the first radiating units 2 and the second radiating units 3 can be replaced by a plurality of radiating sets with different antenna operating frequencies (referring to FIG. 1). The radiating sets with different antenna operating frequencies are disposed on the grounding unit 1. Each radiating set has a plurality of radiating units with the same operating frequency, for example, each radiating set has a plurality of first radiating units 2 with the same operating frequency, such as 2.4 GHz and a plurality of second radiating units 3 with the same operating frequency, such as 5 GHz. In addition, each radiating unit has a radiating body parallel to the surface of the grounding unit, a feeding pin being extended downwards from one side of the radiating body and being suspended and a shorting pin being extended downwards from one side of the radiating body and being connected to the grounding unit, such as the definitions of the above-mentioned each first radiating unit 2 and each second radiating unit 3. Furthermore, an included angle θ each between every two adjacent radiating units of the radiating sets are the same, an included angle θ' each between every two radiating units of each radiating set are the same (shown as FIG. 1), the radiating units of the radiating sets are alternately and symmetrically arranged on the grounding unit 1, and the grounding unit 1 and the radiating units of the radiating sets are enclosed by the antenna system housing C (the same as the example of FIG. 10).

In conclusion, the present invention has the following advantages:

1. In the above-mentioned examples, the present invention uses three independent single-band antennas for 2.4 GHz band and three independent single-band antennas for 5 GHz band in order to achieve concurrent dual-band operation. Hence, the present invention is different from the dual-band antenna of the prior art. For example, the dual-band antenna of the prior art has a single signal feeding port only, so that the dual-band antenna of the prior art needs to use diplexers to achieve concurrent dual-band operation. Therefore, for the dual-band antenna of the prior art, the cost would be increased and the whole system power loses extra gain.

2. The multi-antenna module of the present invention can be hidden in the antenna system product, such as router, in order to enhance the appearance of the product that uses the built-in multi-antenna module.

3. In the examples of the present invention, the first radiating units and the second radiating units can be bent to reduce the height of the multi-antenna module. The present invention can obtain good impedance match (2:1 VSWR or 10 dB return loss) for WLAN operation in 2.4/5 GHz by adjusting the height of the radiating units and the distance between each feeding pin and each shorting pin.

4. Because the shorting pin of each radiating unit with one antenna operating frequency is adjacent to the feeding pin of each radiating unit with another antenna operating frequency, the mutual coupling between every two radiating units with different antenna operating frequencies is substantially decreased and the isolation can remain under −15 dB.

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A built-in multi-antenna module, comprising:

a grounding unit;

a plurality of first radiating units disposed on the grounding unit, wherein each first radiating unit has a first radiating body parallel to the surface of the grounding unit, a first feeding pin being extended downwards from one side of the first radiating body and being suspended, and a first shorting pin being extended downwards from one side of the first radiating body and being connected to the grounding unit; and a plurality of second radiating units disposed on the grounding unit, wherein each second radiating unit has a second radiating body parallel to the surface of the grounding unit, a second feeding pin being extended downwards from one side of the second radiating body and being suspended, and a second shorting pin being extended downwards from one side of the second radiating body and being connected to the grounding unit;

wherein the first radiating units and the second radiating units are alternately and symmetrically arranged on the grounding unit, many included angles respectively formed between each first radiating unit and each second radiating unit are the same.

2. The built-in multi-antenna module according to claim 1, wherein the grounding unit is a regular polygonal conductive plate or a circular conductive plate.

3. The built-in multi-antenna module according to claim 1, further comprising a plurality of signal wires respectively connected to the first feeding pins and the second feeding pins, wherein the grounding unit has a through hole formed on a central portion thereof, and the signal wires pass through the through hole.

4. The built-in multi-antenna module according to claim 1, wherein the number of the first radiating units is three, the number of the second radiating units is three, and each included angle between each first radiating unit and each second radiating unit is 60 degrees.

5. The built-in multi-antenna module according to claim 1, wherein the first feeding pin of each first radiating unit is adjacent to the second shorting pin of one adjacent second radiating unit, and the first shorting pin of each first radiating unit is adjacent to the second feeding pin of another adjacent second radiating unit, wherein the second feeding pin of each second radiating unit is adjacent to the first shorting pin of one adjacent first radiating unit, and the second shorting pin of each second radiating unit is adjacent to the first feeding pin of another adjacent first radiating unit.

6. The built-in multi-antenna module according to claim 1, wherein the first feeding pin and the first shorting pin of each first radiating unit are separated from each other by a predetermined distance, and the second feeding pin and the second shorting pin of each second radiating unit are separated from each other by a predetermined distance.

7. The built-in multi-antenna module according to claim 1, wherein the first feeding pin and the first shorting pin of each first radiating unit are disposed on the same plane or different planes, and the second feeding pin and the second shorting pin of each second radiating unit are disposed on the same plane or different planes.

8. The built-in multi-antenna module according to claim 1, wherein shapes of the first radiating units are the same, and shapes of the second radiating units are the same, wherein antenna operating frequencies of the first radiating units are the same, and antenna operating frequencies of the second radiating units are the same.

9. The built-in multi-antenna module according to claim 1, wherein the first feeding pins are respectively vertically or slantwise extended downwards from the side of the first radiating bodies, and the first shorting pins are respectively vertically or slantwise extended downwards from the side of the first radiating bodies, wherein the second feeding pins are respectively vertically or slantwise extended downwards from the side of the second radiating bodies, and the second shorting pins are respectively vertically or slantwise extended downwards from the side of the second radiating bodies.

10. The built-in multi-antenna module according to claim 1, wherein each first feeding pin has a first feeding point on a bottom portion thereof, each second feeding pin has a second feeding point on a bottom portion thereof, and the first feeding points and the second feeding points face a geometric center of the grounding unit.

11. The built-in multi-antenna module according to claim 1, wherein each first radiating unit has a first extending portion extended downwards from another side of the first radiating body, and each second radiating unit has a second extending portion extended downwards from another side of the second radiating body.

12. The built-in multi-antenna module according to claim 11, wherein each first extending portion is bent continuously and downwards from each first radiating body, and each second extending portion is bent continuously and downwards from each second radiating body.

13. A built-in multi-antenna module installed in an antenna system housing, comprising:

a grounding unit;

a plurality of first radiating units disposed on the grounding unit, wherein each first radiating unit has a first radiating body parallel to the surface of the grounding unit, a first feeding pin being extended downwards from one side of the first radiating body and being suspended, and a first shorting pin being extended downwards from one side of the first radiating body and being connected to the grounding unit; and a plurality of second radiating units disposed on the grounding unit, wherein each second radiating unit has a second radiating body parallel to the surface of the grounding unit, a second feeding pin being extended downwards from one side of the second radiating body and being suspended, and a second shorting pin being extended downwards from one side of the second radiating body and being connected to the grounding unit;

wherein the first radiating units and the second radiating units are alternately and symmetrically arranged on the grounding unit, many included angles respectively formed between each first radiating unit and each second radiating unit are the same, and the grounding unit, the first radiating units and the second radiating units are enclosed by the antenna system housing.

14. The built-in multi-antenna module according to claim 13, wherein the first feeding pin of each first radiating unit is adjacent to the second shorting pin of one adjacent second radiating unit, and the first shorting pin of each first radiating unit is adjacent to the second feeding pin of another adjacent second radiating unit, wherein the second feeding pin of each second radiating unit is adjacent to the first shorting pin of one adjacent first radiating unit, and the second shorting pin of each second radiating unit is adjacent to the first feeding pin of another adjacent first radiating unit.

15. The built-in multi-antenna module according to claim 13, wherein the first feeding pin and the first shorting pin of each first radiating unit are separated from each other by a predetermined distance, and the second feeding pin and the second shorting pin of each second radiating unit are separated from each other by a predetermined distance.

16. The built-in multi-antenna module according to claim 13, wherein the first feeding pins are respectively vertically or slantwise extended downwards from the side of the first radiating bodies, and the first shorting pins are respectively vertically or slantwise extended downwards from the side of the first radiating bodies, wherein the second feeding pins are respectively vertically or slantwise extended downwards from the side of the second radiating bodies, and the second shorting pins are respectively vertically or slantwise extended downwards from the side of the second radiating bodies.

17. The built-in multi-antenna module according to claim 13, wherein each first radiating unit has a first extending portion extended downwards from another side of the first radiating body, each second radiating unit has a second extending portion extended downwards from another side of the second radiating body, each first extending portion is bent continuously and downwards from each first radiating body, and each second extending portion is bent continuously and downwards from each second radiating body.

18. A built-in multi-antenna module installed in an antenna system housing, comprising:

a grounding unit; and a plurality of radiating sets with different antenna operating frequencies disposed on the grounding unit, wherein each radiating set has a plurality of radiating units with the same operating frequency, and each radiating unit has a radiating body parallel to the surface of the grounding unit, a feeding pin being extended downwards from one side of the radiating body and being suspended and a shorting pin being extended downwards from one side of the radiating body and being connected to the grounding unit;

wherein many included angles respectively formed between every two adjacent radiating units of the radiating sets are the same, many included angles respectively formed between every two radiating units of each radiating set are the same, the radiating units of the radiating sets are alternately and symmetrically arranged on the grounding unit, and the grounding unit and the radiating units of the radiating sets are enclosed by the antenna system housing.

19. The built-in multi-antenna module according to claim 18, wherein the different antenna operating frequencies are in the 2.4 GHz and 5 GHz bands.

20. The built-in multi-antenna module according to claim 18, wherein the number of the radiating units of each radiating set is three, and each included angle between every two adjacent radiating units of the radiating sets is 60 degrees.

* * * * *